US009679577B2

(12) United States Patent
Endo

(10) Patent No.: US 9,679,577 B2
(45) Date of Patent: Jun. 13, 2017

(54) VOICE SWITCHING DEVICE, VOICE SWITCHING METHOD, AND NON-TRANSITORY COMPUTER-READABLE RECORDING MEDIUM HAVING STORED THEREIN A PROGRAM FOR SWITCHING BETWEEN VOICES

(71) Applicant: FUJITSU LIMITED, Kawasaki-shi, Kanagawa (JP)

(72) Inventor: Kaori Endo, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/800,107

(22) Filed: Jul. 15, 2015

(65) Prior Publication Data

US 2016/0042747 A1 Feb. 11, 2016

(30) Foreign Application Priority Data

Aug. 8, 2014 (JP) ..... 2014-163023

(51) Int. Cl.
*G10L 21/0208* (2013.01)
*G10L 21/02* (2013.01)
(Continued)

(52) U.S. Cl.
CPC ..... *G10L 21/0208* (2013.01); *G10L 21/02* (2013.01); *G10L 21/0216* (2013.01);
(Continued)

(58) Field of Classification Search
CPC ..... G10L 21/0208
See application file for complete search history.

(56) References Cited

U.S. PATENT DOCUMENTS 5,740,531 A 4/1998 Okada
5,937,375 A * 8/1999 Nakamura ..... G10L 25/78 704/214

(Continued)

FOREIGN PATENT DOCUMENTS

EP 1814106 8/2007
JP 2003-158767 5/2003

(Continued)

OTHER PUBLICATIONS

Extended European Search Report dated Feb. 9, 2016, from corresponding to EP Application No. 15175516.2.

(Continued)

*Primary Examiner* — Ibrahim Siddo
(74) *Attorney, Agent, or Firm* — Maschoff Brennan

(57) ABSTRACT

A voice switching device includes a learning unit configured to learn a background noise model expressing background noise contained in a first voice signal, based on the first voice signal, while the first voice signal having a first frequency band is received; a pseudo noise generation unit configured to generate pseudo noise expressing noise in a pseudo manner, based on the background noise model, after a first time point when the first voice signal is last received in a case where a received voice signal is switched from the first voice signal to a second voice signal having a second frequency band narrower than the first frequency band; and a superimposing unit configured to superimpose the pseudo noise on the second voice signal after the first time point.

10 Claims, 7 Drawing Sheets

(51) Int. Cl.

| | |
|---|---|
| ***G10L 25/18*** | (2013.01) |
| ***G10L 21/0216*** | (2013.01) |
| ***G10L 25/48*** | (2013.01) |
| ***G10L 25/84*** | (2013.01) |
| ***G10L 19/18*** | (2013.01) |
| ***G10L 21/038*** | (2013.01) |

(52) U.S. Cl.
CPC ..... *G10L 25/18* (2013.01); *G10L 25/48* (2013.01); *G10L 25/84* (2013.01); *G10L 19/18* (2013.01); *G10L 21/038* (2013.01); *G10L 2021/02087* (2013.01)

(56) References Cited

U.S. PATENT DOCUMENTS

| | | | | |
|---|---|---|---|---|
| 6,349,197 | B1 | 2/2002 | Oestreich | |
| 2005/0084094 | A1* | 4/2005 | Gass | G10L 19/012 379/416 |
| 2005/0228655 | A1* | 10/2005 | Cao | G10L 25/69 704/220 |
| 2007/0276662 | A1* | 11/2007 | Akamine | G10L 15/065 704/233 |
| 2009/0070117 | A1 | 3/2009 | Endo | |
| 2010/0036656 | A1 | 2/2010 | Kawashima et al. | |
| 2011/0040560 | A1* | 2/2011 | Setiawan | G10L 19/012 704/233 |

FOREIGN PATENT DOCUMENTS

| | | |
|---|---|---|
| WO | 02/065458 | 8/2002 |
| WO | 2006/075663 | 7/2006 |

OTHER PUBLICATIONS

Setiawan Panji et al.,"On the ITU-TG.729.1 Silence Compression Scheme", European Signal Processing conference, IEEE, pp. 1-5, XP032760832.

* cited by examiner

VOICE SWITCHING DEVICE, VOICE SWITCHING METHOD, AND NON-TRANSITORY COMPUTER-READABLE RECORDING MEDIUM HAVING STORED THEREIN A PROGRAM FOR SWITCHING BETWEEN VOICES

CROSS-REFERENCE TO RELATED APPLICATION

This application is based upon and claims the benefit of priority of the prior Japanese Patent Application No. 2014-163023, filed on Aug. 8, 2014, the entire contents of which are incorporated herein by reference.

FIELD

The embodiments discussed herein are related to a voice switching device, a voice switching method, and non-transitory computer-readable recording medium having stored therein a program for switching between voices, which each perform switching between a plurality of voice signals where frequency bands containing the respective voice signals are different from one another.

BACKGROUND

In recent years, there have been proposed a plurality of call services in which frequency bands containing transmitted voice signals are different from one another. In a wireless communication system compatible with, for example, Long Term Evolution (LTE), there has been proposed Voice over LTE (VoLTE) in which a communication line compliant with the LTE is utilized and a voice signal is transmitted on an internet protocol (IP) network, thereby realizing a voice call. In the VoLTE, the bandwidth of a transmitted voice signal is set to, for example, about 0 Hz to about 8 kHz and is wider than the bandwidth (about 0 Hz to about 4 kHz) of a voice signal transmitted in a 3G network. Therefore, in a mobile phone in which voice communication services of both the VoLTE and the 3G are provided, in some cases a change in a communication environment or the like causes a communication method for a voice signal to be switched from the VoLTE to the 3G during a voice call. In such a case, since the quality of a received voice changes in association with the switching, a user has a feeling of uncomfortable toward the received voice at the time of the switching in some cases.

Therefore, there has been studied a technology for suppressing discontinuity of a voice signal when the bandwidth of the transmitted voice signal is switched based on a communication environment or the like (see, for example, International Publication Pamphlet No. WO 2006/075663).

To switch the bandwidth of a voice signal to be output, a voice switching device disclosed in, for example, International Publication Pamphlet No. WO 2006/075663, outputs a mixed signal in which a narrowband voice signal and a wideband voice signal are mixed. In addition, this voice switching device changes, with time, a mixing ratio between the narrowband voice signal and the wideband voice signal.

SUMMARY

According to an aspect of the invention, a voice switching device includes a learning unit configured to learn a background noise model expressing background noise contained in a first voice signal, based on the first voice signal, while the first voice signal having a first frequency band is received; a pseudo noise generation unit configured to generate pseudo noise expressing noise in a pseudo manner, based on the background noise model, after a first time point when the first voice signal is last received in a case where a received voice signal is switched from the first voice signal to a second voice signal having a second frequency band narrower than the first frequency band; and a superimposing unit configured to superimpose the pseudo noise on the second voice signal after the first time point.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

However, in the technology disclosed in International Publication Pamphlet No. WO 2006/075663, the narrowband voice signal and the wideband voice signal are mixed. Therefore, it is difficult to apply this technology to a case where only one voice signal of the narrowband voice signal and the wideband voice signal is obtained by switching between communication methods.

According to an aspect, it is desired technology to provide a voice switching device capable of reducing a feeling of uncomfortable when switching between voice signals whose frequency bands are different from each other occurs.

Figure 1:
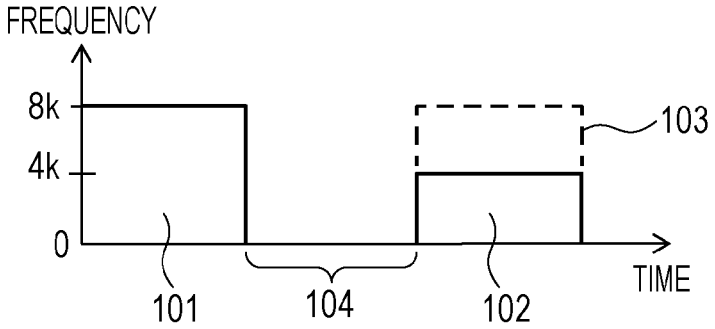
FIG. 1 is a pattern diagram illustrating a change in a frequency band containing a voice signal in a case where a communication method of the voice signal is switched, during a call, from a communication method in which the frequency band containing the voice signal is relatively wide to a communication method in which the frequency band containing the voice signal is relatively narrow.

Hereinafter, a voice switching device will be described with reference to drawings. FIG. 1 is a pattern diagram illustrating a change in a frequency band containing a voice signal in a case where a communication method of the voice signal is switched, during a call, from a communication method in which the frequency band containing the voice signal is relatively wide to a communication method in which the frequency band containing the voice signal is relatively narrow.

In FIG. 1, a horizontal axis indicates time and a vertical axis indicates a frequency. A voice signal 101 indicates a voice signal in a case of using a first communication method (for example, the VoLTE) in which the transmission band of the voice signal is relatively wide. On the other hand, a voice signal 102 indicates a voice signal in a case of using a second communication method (for example, the 3G) in which the transmission band of the voice signal is relatively narrow. The voice signal 101 includes a high-frequency band component, compared with the voice signal 102. Therefore, when an applied communication method is switched, during a call, from the first communication method from the second communication method, a user during the call feels that a high-frequency band component 103, included in the voice signal 101 and not included in the voice signal 102, is missing. In addition, in association with switching processing of the communication method, between termination of regeneration of the voice signal 101 and starting of regeneration of the voice signal 102, a voiceless time period 104 during which no voice signal is received occurs. Such lack of a partial frequency band component or such existence of the voiceless time period causes the user to have a feeling of uncomfortable toward a regenerated received voice.

Therefore, the voice switching device according to the present embodiment learns background noise, based on a voice signal obtained while a call is made using the first communication method in which the transmission band of the voice signal is relatively wide. In addition, at the time of switching, during the call, from the first communication method to the second communication method in which the transmission band of the voice signal is relatively narrow, the voice switching device generates pseudo noise, based on the learned background noise, and superimposes the pseudo noise on the voiceless time period immediately after the switching and the missing frequency band. Furthermore, the voice switching device obtains the degree of similarity between a voice signal received by the second communication method after the switching and the background noise and increases the length of a time period during which the pseudo noise is superimposed, with an increase in the degree of similarity. The voice switching device performs as above described and thus the user may feel less uncomfortable at the time of switching between the voice signals.

Figure 2:
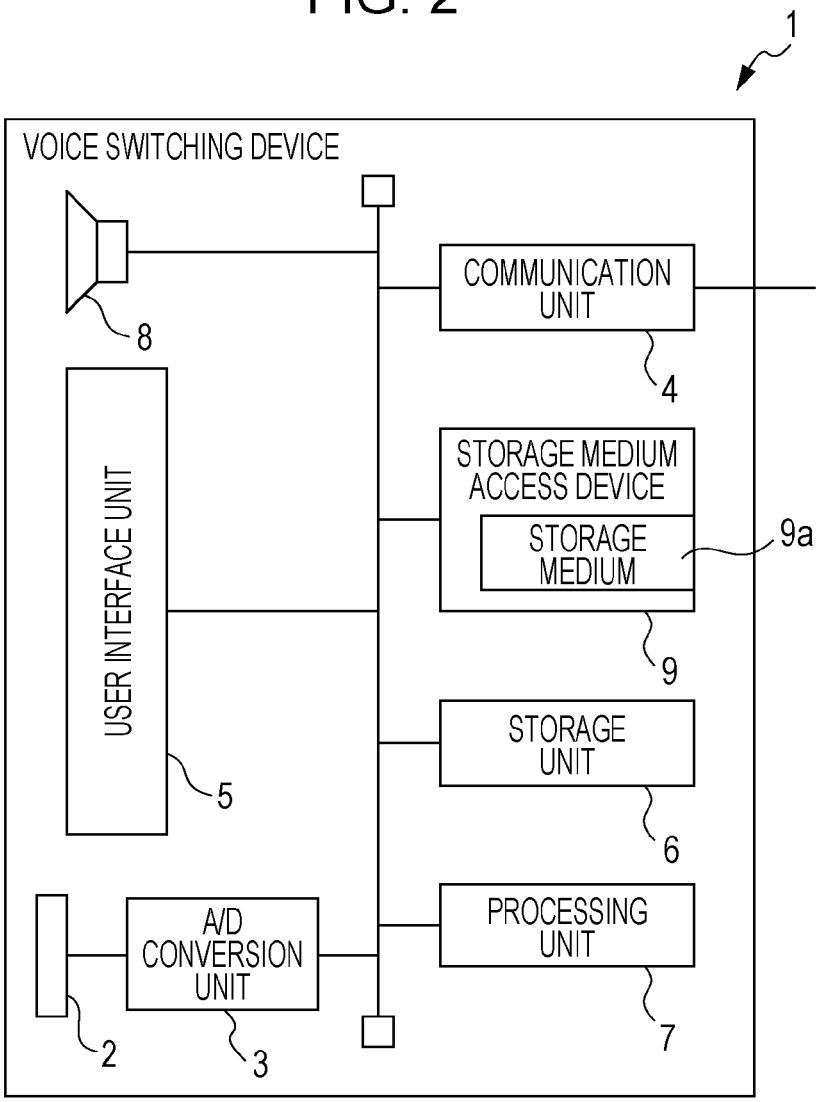
FIG. 2 is a schematic configuration diagram of a voice switching device according to an embodiment.

FIG. 2 is a schematic configuration diagram of a voice switching device according to an embodiment. In this example, a voice switching device 1 is implemented as a mobile phone. In addition, the voice switching device 1 includes a voice collection unit 2, an analog-to-digital conversion unit 3, a communication unit 4, a user interface unit 5, a storage unit 6, a processing unit 7, an output unit 8, and a storage medium access device 9. Note that this voice switching device may use a plurality of communication methods in which frequency bands containing voice signals are different, and is able to be applied to various communication devices each capable of switching a communication method during a call.

The voice collection unit 2 includes, for example, a microphone, collects a voice propagated through space around the voice collection unit 2, and generates an analog voice signal that has an intensity corresponding to the sound pressure of the voice. In addition, the voice collection unit 2 outputs the generated analog voice signal to the analog-to-digital conversion unit (hereinafter, called an A/D conversion unit) 3.

The A/D conversion unit 3 includes an amplifier, for example and an analog-to-digital converter. The A/D conversion unit 3 amplifies the analog voice signal received from the voice collection unit 2 by using the amplifier. The A/D conversion unit 3 samples the amplified analog voice signal with a predetermined sampling period (corresponding to, for example, 8 kHz) by using the analog-to-digital converter to generate a digitalized voice signal.

The communication unit 4 transmits, to another apparatus, a voice signal generated by the voice collection unit 2 and coded by the processing unit 7. The communication unit 4 extracts a voice signal included in a signal received from another apparatus and outputs the extracted voice signal to the processing unit 7. For these processes, the communication unit 4 includes, for example, a baseband processing unit (not illustrated), a wireless processing unit (not illustrated), and an antenna (not illustrated). The baseband processing unit in the communication unit 4 generates an up-link signal by modulating the voice signal coded by the processing unit 7, in accordance with a modulation method compliant with a wireless communication standard with which the communication unit 4 is compliant. The wireless processing unit in the communication unit 4 superimposes the up-link signal on a carrier wave having a wireless frequency. The superimposed up-link signal is transmitted to another apparatus through the antenna. In addition, the wireless processing unit in the communication unit 4 receives a down-link signal including a voice signal from another apparatus through the antenna, converts the received down-link signal into a signal having a baseband frequency, and outputs the converted signal to the baseband processing unit. The baseband processing unit demodulates the signal received from the wireless processing unit and extracts and transfers various kinds of signals or pieces of information such as a voice signal and so forth, included in the signal, to the processing unit 7. In such a case, the baseband processing unit selects a communication method in accordance with a control signal indicated by the processing unit 7 and demodulates the signals in accordance with the selected communication method.

The user interface unit 5 includes a touch panel, for example. The user interface unit 5 generates an operation signal corresponding to an operation due to the user, for example, a signal instructing to start a call, and outputs the operation signal to the processing unit 7. In addition, the user interface unit 5 displays an icon, an image, a text, or the like, in accordance with a signal for display received from the processing unit 7. Note that the user interface unit 5 may separately include a plurality of operation buttons for inputting operation signals and a display device such as a liquid crystal display.

The storage unit 6 includes a readable and writable semiconductor memory and a read only semiconductor memory, for example. The storage unit 6 stores therein also various kinds of computer programs and various kinds of data, which are used in the voice switching device 1. Further, the storage unit 6 stores therein various kinds of information used in voice switching processing.

The processing unit 7 includes one or more processors, a memory circuit, and a peripheral circuit. The processing unit 7 controls the entire voice switching device 1.

When, for example, a call is started based on an operation of the user which is performed through the user interface unit 5, the processing unit 7 performs call control processing operations such as calling out, a response, and truncation.

The processing unit 7 performs high efficiency coding on the voice signal generated by the voice collection unit 2 and furthermore performs channel coding thereon, thereby outputting the coded voice signal through the communication unit 4. In response to a communication environment or the like, the processing unit 7 selects a communication method used for communicating a voice signal and controls the communication unit 4 so as to communicate the voice signal in accordance with the selected communication method. The processing unit 7 decodes a coded voice signal received from another apparatus through the communication unit 4 in accordance with the selected communication method, and outputs the decoded voice signal to the output unit 8. The processing unit 7 performs voice switching processing associated with switching an applied communication method from the first communication method (for example, the VoLTE) in which a frequency band containing the voice signal is relatively wide to the second communication method (for example, the 3G) in which a frequency band containing the voice signal is relatively narrow. During performing the voice switching processing, the processing unit 7 transfers the decoded voice signal to individual units that perform the voice switching processing. In addition, the processing unit 7 transfers the voice signal to be voiceless to individual units that perform the voice switching processing between termination of the voice signal received in accordance with the communication method before the switching and starting of receiving the voice signal in accordance with the communication method after the switching. Note that the details of the voice switching processing based on the processing unit 7 will be described later.

The output unit 8 includes, for example, a digital-to-analog converter used for converting the voice signal received from the processing unit 7 into an analog signal and a speaker and regenerates the voice signal received from the processing unit 7 as an acoustic wave.

The storage medium access device 9 is a device that accesses a storage medium 9*a* such as a semiconductor memory card, for example. The storage medium access device 9 reads a computer program which is stored in the storage medium 9*a*, for example, and is to be performed on the processing unit 7, and transfers the computer program to the processing unit 7.

Hereinafter, the details of the voice switching processing based on the processing unit 7 will be described.

Figure 3:
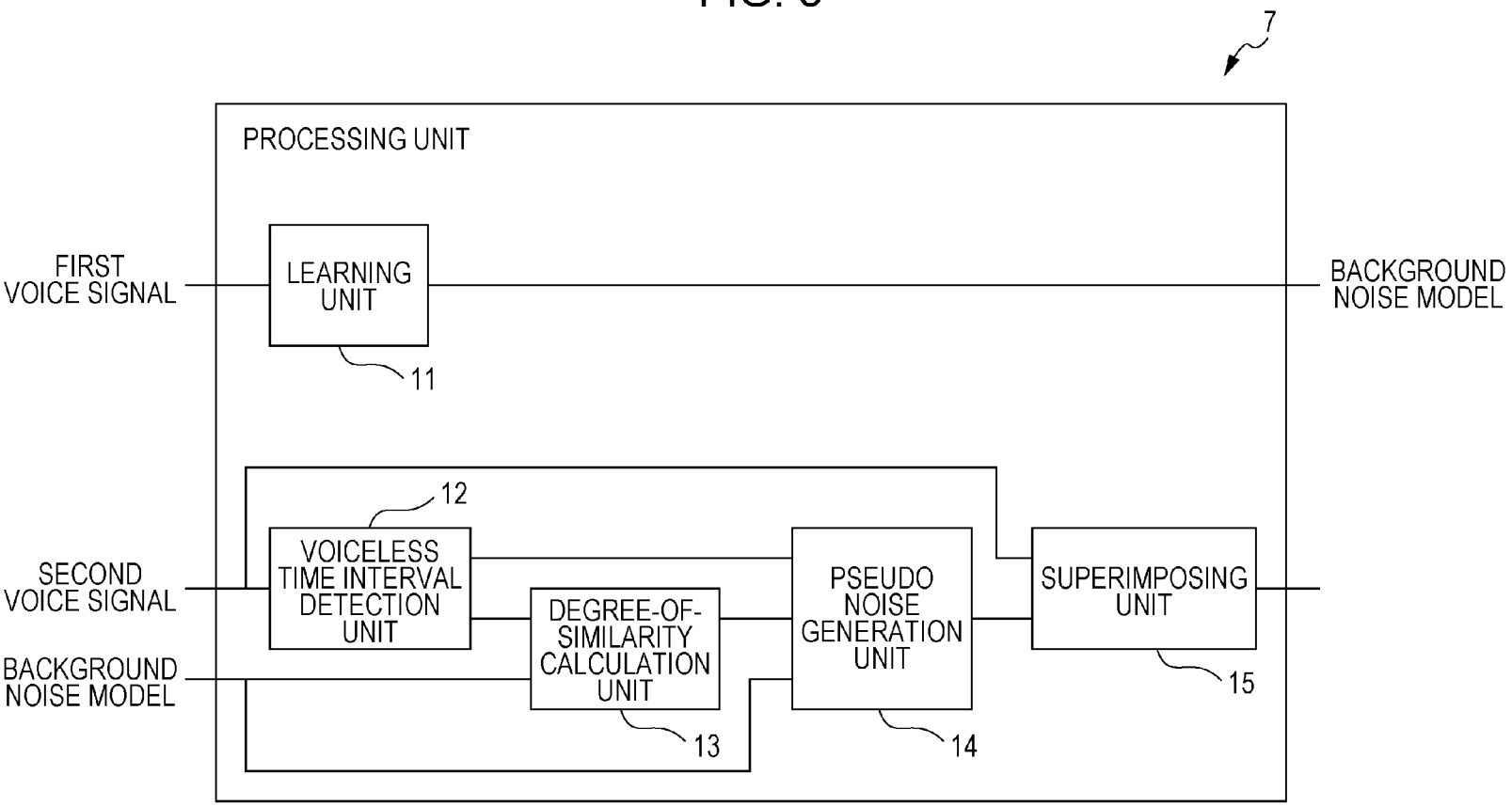
FIG. 3 is a schematic configuration diagram of a processing unit.

FIG. 3 is a schematic configuration diagram of the processing unit 7. The processing unit 7 includes a learning unit 11, a voiceless time interval detection unit 12, a degree-of-similarity calculation unit 13, a pseudo noise generation unit 14, and a superimposing unit 15.

The individual units included in the processing unit 7 are implemented as functional modules realized by a computer program performed on a processor included in the processing unit 7, for example. Alternatively, the individual units included in the processing unit 7 may be implemented as one integrated circuit separately from the processor included in the processing unit 7 to realize the functions of the respective units in the voice switching device 1.

In addition, the learning unit 11 among the individual units included in the processing unit 7 is applied while the voice switching device 1 receives a voice signal from another apparatus in accordance with the first communication method. On the other hand, the voiceless time interval detection unit 12, the degree-of-similarity calculation unit 13, the pseudo noise generation unit 14, and the superimposing unit 15 are applied during switching from the first communication method to the second communication method or alternatively, during a given period of time after the switching is completed and reception of a voice signal in accordance with the second communication method is started.

For convenience of explanation, a voice signal received using the first communication method in which a frequency band containing the voice signal is relatively wide is referred to as a first voice signal hereinafter. In addition, a voice signal received using the second communication method in which a frequency band containing the voice signal is relatively narrow is referred to as a second voice signal hereinafter. Furthermore, a frequency band containing the first voice signal is called a first frequency band. On the other hand, a frequency band containing the second voice signal is called a second frequency band. In other words, the first frequency band (for example, about 0 kHz to about 8 kHz) is wider than the second frequency band (for example, about 0 kHz to about 4 kHz).

The learning unit 11 learns a background noise model expressing background noise included in the first voice signal. The background noise model is used for generating pseudo noise to be superimposed on the second voice signal. For this purpose, the learning unit 11 divides the first voice signal into frame units each having a predetermined length of time (for example, several tens of milliseconds). And then, the learning unit 11 calculates power P(t) of a current frame and compares the power P(t) with a predetermined threshold value Th1. In a case where the power P(t) is less than the threshold value Th1, it is estimated that no voice of a call partner is included in the corresponding frame and the background noise is only included therein. Note that the Th1 is set to 6 dB, for example. In this case, by subjecting the first voice signal of the current frame to time-frequency transform, the learning unit 11 calculates a first frequency signal serving as a signal in a frequency domain. The learning unit 11 may use fast Fourier transform (FFT) or modified discrete cosine transform (MDCT), for example, as the time-frequency transform. The first frequency signal includes, for example, frequency spectra corresponding to half of the total number of sampling points included in the corresponding frame.

The learning unit 11 calculates the power spectrum of the first frequency signal of the current frame in accordance with the following Expression (1), for example.

$$P(i,t)=\sqrt{Re(i,t)^2+Im(i,t)^2} \tag{1}$$

Here, Re(i,t) indicates the real part of a spectrum at a frequency indicated by an i-th sample point of the first frequency signal in a current frame t. In addition, Im(i,t) indicates the imaginary part of the spectrum at the frequency indicated by the i-th sample point of the first frequency signal in the current frame t. In addition, P(i,t) is a power spectrum at the frequency indicated by the i-th sample point in the current frame t.

In addition, the learning unit 11 performs, using a forgetting coefficient, weighted sum calculation between the power spectrum of the current frame and the power spectrum of the background noise model in accordance with the following Expression, thereby learning the background noise model.

$$PN(i,t)=\alpha PN(i,t-1)+(1-\alpha)P(i,t) \tag{2}$$

Here, PN(i,t) and PN(i,t−1) are power spectra indicated by the i-th sample point in the background noise model in the current frame t and a frame (t−1) one frame prior thereto, respectively. In addition, a coefficient $\alpha$ is the forgetting coefficient and is set to 0.99, for example.

On the other hand, in a case where the power P(t) of the current frame is greater than or equal to the threshold value Th1, the learning unit 11 estimates that the current frame is a vocalization time interval serving as a time interval containing a voice other than the background noise, for example, the voice of a speaker serving as a call partner. In this case, the learning unit 11 does not update the background noise model PN(i,t) and defines the background noise model PN(i,t) as being identical to a background noise model PN(i,t−1) for the frame (t−1) one frame prior to the current frame. Alternatively, the learning unit 11 may make the forgetting coefficient α in Expression (2) larger than that in a case where the power P(t) is less than the threshold value Th1 (for example, α=0.999) and may update the background noise model in accordance with Expression (1) and Expression (2).

As an example of a modification, the learning unit 11 may compare the power P(t) with a value (PNave−Th2) obtained by subtracting an offset Th2 from power PNave(=ΣPN(i,t−1)) of the entire bandwidth of the background noise model in a frame one frame prior to the current frame. The Th2 is set to 3 dB, for example. In this case, in a case where the power P(t) is less than the (PNave−Th2), the learning unit 11 may update the background noise model in accordance with Expression (1) and Expression (2).

The learning unit 11 stores the latest background noise model, in other words, the background noise model PN(i,t) learned for the current frame in the storage unit 6.

While the voice switching processing is performed after a time point when a voice signal is last received in accordance with the first communication method, the voiceless time interval detection unit 12 detects a voiceless time interval during which reception of the second voice signal is not started.

For this purpose, the voiceless time interval detection unit 12 divides a voice signal received from the processing unit 7 into frame units each having a predetermined length of time (for example, several tens of milliseconds). And then, the voiceless time interval detection unit 12 calculates the power P(t) of the current frame and compares the power P(t) with a predetermined threshold value Th3. In a case where the power P(t) is less than the threshold value Th3, it is determined that the current frame is the voiceless time interval. The Th3 is set to 6 dB, for example. On the other hand, in a case where the power P(t) is greater than or equal to the threshold value Th3, the voiceless time interval detection unit 12 determines that the current frame is not the voiceless time interval.

With respect to each frame, the voiceless time interval detection unit 12 notifies the degree-of-similarity calculation unit 13 and the pseudo noise generation unit 14 of a result indicating whether being the voiceless time interval or not.

In a case where the current frame is not the voiceless time interval while the voice switching processing is performed after the time point when the voice signal is last received in accordance with the first communication method, the degree-of-similarity calculation unit 13 calculates the degree of similarity between the second voice signal included in the current frame and the background noise model. The degree of similarity is used for setting a time period during which the pseudo noise is superimposed on the second voice signal. It is assumed that the feeling of uncomfortable of the user toward a voice obtained by superimposing the pseudo noise generated from the background noise model on the second voice signal decreases with an increase in the degree of similarity between the second voice signal and the background noise model. Therefore, a time period during which the pseudo noise is superimposed is set to be longer with an increase in the degree of similarity. For the sake of convenience, the degree of similarity between the second voice signal and the background noise model is referred to as the degree of noise similarity.

Figure 4:
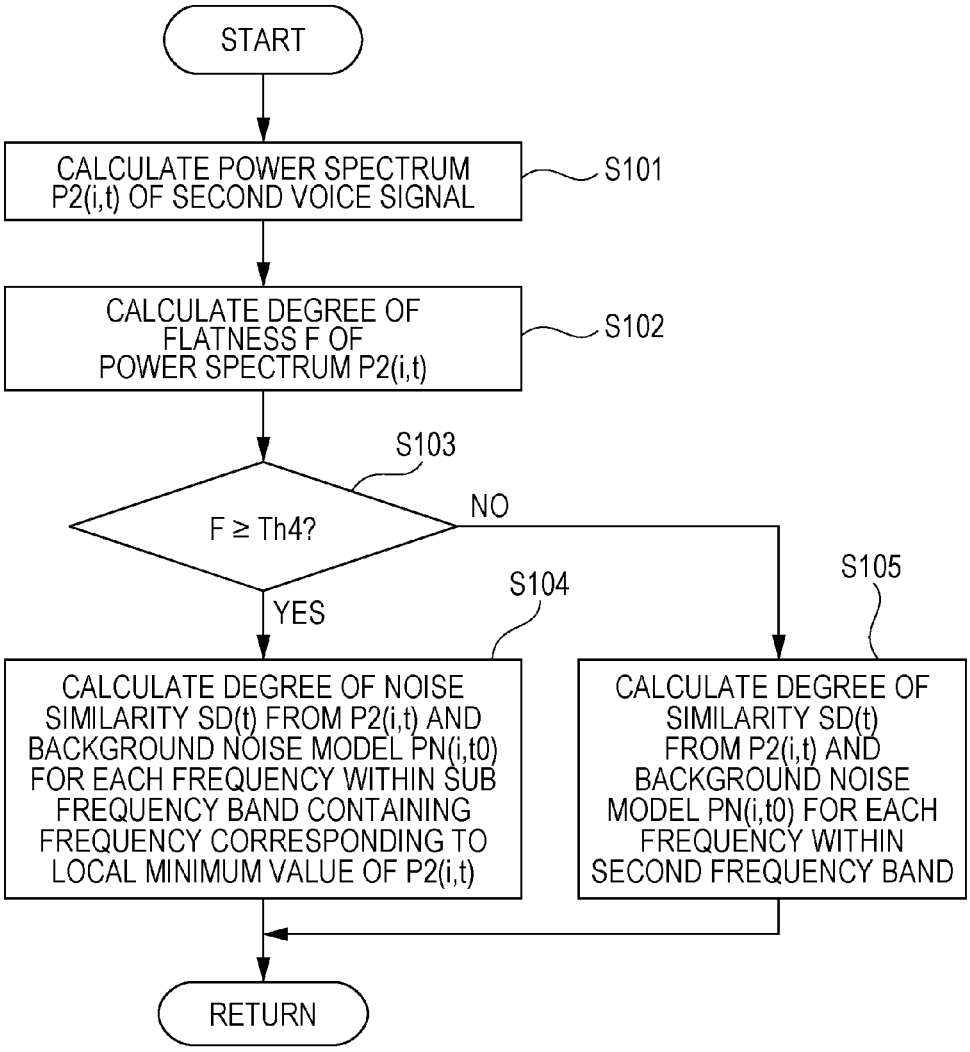
FIG. 4 is an operation flowchart of degree-of-noise-similarity calculation processing.

FIG. 4 is an operation flowchart of degree-of-noise-similarity calculation processing based on the degree-of-similarity calculation unit 13. In accordance with this operation flowchart, the degree-of-similarity calculation unit 13 calculates the degree of noise similarity for each frame.

The degree-of-similarity calculation unit 13 calculates a power spectrum P2(*i,t*) at each frequency of the second voice signal in the current frame t (step S101). For this purpose, the degree-of-similarity calculation unit 13 may calculate a second frequency signal for the current frame by performing time-frequency transform on the second voice signal and may calculate a power spectrum P2(*i,t*) by applying Expression (1) to the second frequency signal. And then, the degree-of-similarity calculation unit 13 calculates the degree of flatness F expressing how flat the power spectrum is over the entire frequency band (step S102). Note that the degree of flatness F is calculated in accordance with, for example, the following Expression (3).

$$F=\mathrm{MAX}(P2(i,t))-\mathrm{MIN}(P2(i,t)) \tag{3}$$

Here, MAX(P2(*i,t*)) is a function for outputting a maximum value out of the power spectrum over the entire frequency band and MIN(P2(*i,t*)) is a function for outputting a minimum value out of the power spectrum over the entire frequency band. As is clear from Expression (3), in this case, the power spectrum P2(*i,t*) becomes more flat and differences between the values of power spectra at individual frequencies become smaller as the value of the degree of flatness F becomes smaller. Note that the degree-of-similarity calculation unit 13 may calculate the degree of flatness F in accordance with another expression for obtaining how flat a function is.

The degree-of-similarity calculation unit 13 determines whether or not the degree of flatness F is greater than or equal to a predetermined threshold value Th4 (step S103). The threshold value Th4 is set to, for example, 6 dB. In a case where the degree of flatness F is greater than or equal to the threshold value Th4 (step S103: Yes), there is a possibility that the component of a sound other than the background noise is included in the current frame. Therefore, for a sub frequency band containing a frequency at which the value of the power spectrum P2(*i,t*) becomes a local minimum value, the degree-of-similarity calculation unit 13 calculates the degree of noise similarity SD(t) between the power spectrum P2(*i,t*) and the background noise model PN(i,t) (step S104). The reason is that a possibility that the component of a sound other than the background noise is included is low at the frequency at which the value of the power spectrum P2(*i,t*) becomes a local minimum value and a frequency in the vicinity thereof. In addition, the sub frequency band is narrower than the second frequency band and may be defined as a frequency band corresponding to, for example, ($i_0$±3) when it is assumed that a sampling point corresponding to the frequency at which the value of the power spectrum P2(*i,t*) becomes a local minimum value is $i_0$.

The degree-of-similarity calculation unit 13 determines that the value of the power spectrum P2(*i,t*) becomes a local minimum value with respect to a frequency that satisfies the following conditions (4), for example, and corresponds to an i-th sampling point.

$$P2(i-1,t) > P2(i,t)$$
$$P2(i+1,t) > P2(i,t)$$
$$P2_{ave}(i,t) - Thave > P2(i,t)$$
$$P2_{ave}(i,t) = \frac{1}{2N_2+1}\sum_{i-N_2}^{i+N_2} P2(i,t) \quad (4)$$

Here, a variable $N_2$ indicating the width of a frequency band used for calculating the local average value Pave(i,t) of a power spectrum is set to 5, for example. In addition, the threshold value Thave is set to 5 dB, for example. The degree-of-similarity calculation unit 13 extracts all frequencies each satisfying the conditions of Expression (4).

Figure 5:
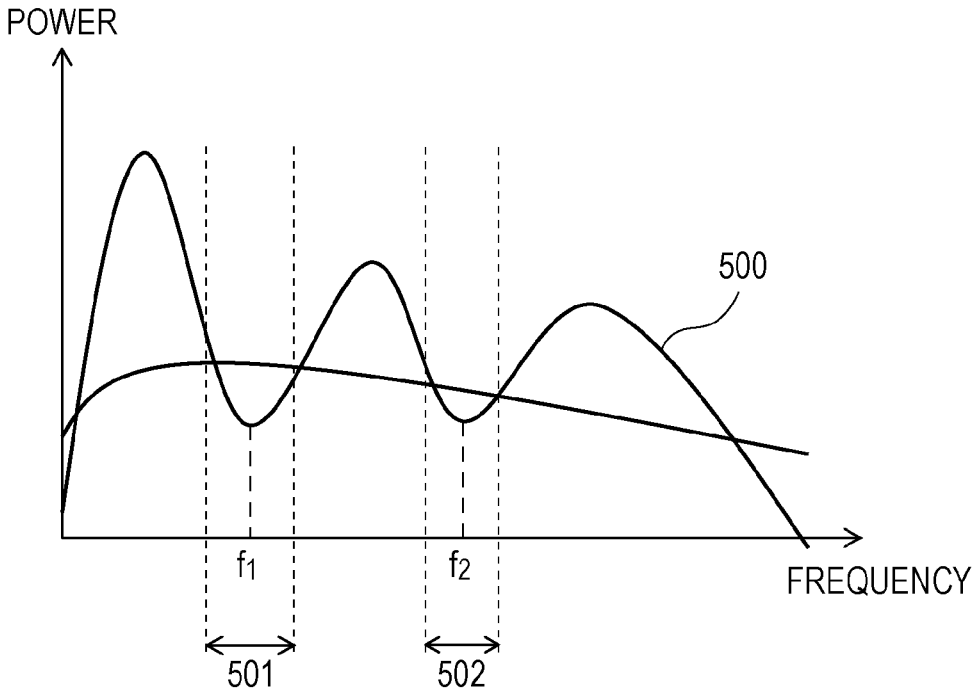
FIG. 5 is a diagram illustrating an example of a sub frequency band used for calculating the degree of noise similarity in a case where a power spectrum of a second voice signal is not flat.

FIG. 5 is a diagram illustrating an example of the sub frequency band used for calculating the degree of noise similarity SD(t) in a case where the power spectrum of the second voice signal is not flat. In FIG. 5, a horizontal axis indicates a frequency and a vertical axis indicates power. In this example, a power spectrum 500 for individual frequencies has local minimum values at a frequency f1 and a frequency f2. Therefore, a sub frequency band 501 and a sub frequency band 502, centered at the frequency f1 and the frequency f2, respectively, are used for calculating the degree of noise similarity SD(t).

In accordance with the following Expression (5), the degree-of-similarity calculation unit 13 calculates the root mean squared error of differences between the power spectra P2(*i,t*) and the background noise model PN(i,t) at individual frequencies contained in the sub frequency band containing the frequency at which the power spectrum P2(*i,t*) becomes a local minimum value. In addition, the degree-of-similarity calculation unit 13 defines the root mean squared error as the degree of noise similarity SD(t).

$$SD(t) = \sqrt{\frac{1}{N}\sum_j (P2(j,t) - PN(j,t_0))^2} \quad (5)$$

Note that N is the number of sampling points corresponding to individual frequencies that are extracted in accordance with Expression (4) and contained in one or more sub frequency bands each containing a frequency at which the power spectrum P2(*i,t*) becomes a local minimum value. "j" is a sampling point corresponding to one of the frequencies contained in one or more sub frequency bands each containing a frequency at which the power spectrum P2(*i,t*) becomes a local minimum value. In addition, $t_0$ indicates a frame in which the background noise model is last updated.

In addition, in a case where, in the step S103, the degree of flatness F is less than the threshold value Th4 (step S103: No), a possibility that the component of a sound other than the background noise is included in the current frame is low. Therefore, in accordance with the following Expression (6), the degree-of-similarity calculation unit 13 calculates the root mean squared error of differences between the power spectra P2(*i,t*) and the background noise model PN(i,t) at individual frequencies over the entire frequency band containing the second voice signal. The degree-of-similarity calculation unit 13 defines the root mean squared error as the degree of noise similarity SD(t) (step S105).

$$SD(t) = \sqrt{\frac{1}{L_{max}}\sum_{i=1}^{L_{max}} (P2(i,t) - PN(i,t_0))^2} \quad (6)$$

Note that Lmax is the number of a sampling point corresponding to the upper limit frequency of the second frequency band containing the second voice signal.

As is clear from Expression (5) and Expression (6), the degree of similarity between the second voice signal and the background noise model increases with an decrease in the value of the degree of noise similarity SD(t). Note that calculation formulae for the degree of similarity between the second voice signal and the background noise model are not limited to Expression (5) and Expression (6). As a calculation formula for the degree of similarity, for example, the reciprocal of the right side of Expression (5) or Expression (6) may be used.

Every time the degree of noise similarity SD(t) is calculated, the degree-of-similarity calculation unit 13 notifies the pseudo noise generation unit 14 of the degree of noise similarity SD(t).

The pseudo noise generation unit 14 generates pseudo noise to be superimposed on the second voice signal based on the degree of similarity SD(t) and the background noise model.

In a case where the current frame is the voiceless time interval, the pseudo noise generation unit 14 generates the pseudo noise for a frequency band from the lower limit frequency of the second frequency band to the upper limit frequency fmax(t) of the pseudo noise. In the present embodiment, when the second frequency band containing the second voice signal is compared with the first frequency band containing the first voice signal, the upper limit frequency of the first frequency band is higher than the upper limit frequency of the second frequency band, as illustrated in FIG. 1. Therefore, the upper limit frequency fmax(t) of the pseudo noise is set to a frequency higher than the upper limit frequency of the second frequency band and less than or equal to the upper limit frequency of the first frequency band.

On the other hand, in a case where the current frame is not the voiceless time interval, the pseudo noise generation unit 14 generates the pseudo noise for a frequency band between the upper limit frequency fmax(t) of the pseudo noise and the upper limit frequency of the second frequency band.

In addition, in accordance with an elapsed time from a time point when reception of the first voice signal based on the first communication method is terminated, the pseudo noise generation unit 14 decreases the upper limit frequency fmax(t) of the pseudo noise. For example, in accordance with the following Expression (7), the pseudo noise generation unit 14 determines the upper limit frequency fmax(t) of the current frame in accordance with the upper limit frequency fmax(t−1) of the frame (t−1) one frame prior to the current frame and the degree of noise similarity SD(t) of the current frame. In addition, the initial value of the upper limit frequency fmax(t) may be set to the upper limit frequency (for example, 8 kHz) of the first frequency band.

$$f\max(t) = \gamma(t)\cdot f\max(t-1) \quad (7)$$
$$\gamma(t) = 0$$
$$ThSD \le SD(t)$$

-continued $$\gamma(t) = 1 - \frac{SD(t)}{ThSD}$$

$$0 \leq SD(t) < ThSD$$

Note that the threshold value ThSD is set to 5 dB, for example. In addition, the coefficient γ(t) is an updating coefficient used for updating the upper limit frequency fmax(t) of the pseudo noise.

Figure 6:
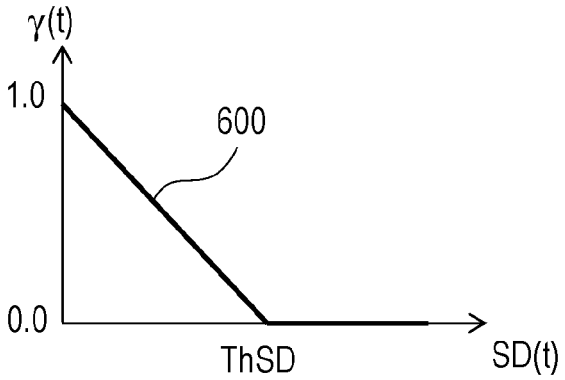
FIG. 6 is a diagram illustrating a relationship between the degree of noise similarity and an updating coefficient.

FIG. 6 is a diagram illustrating a relationship between the degree of noise similarity SD(t) and the updating coefficient γ(t). In FIG. 6, a horizontal axis indicates the degree of noise similarity SD(t) and a vertical axis indicates the updating coefficient γ(t). A graph 600 indicates a relationship between the degree of noise similarity SD(t) and the updating coefficient γ(t).

As is clear from FIG. 6 and Expression (7), the updating coefficient γ(t) increases with a decrease in the degree of noise similarity SD(t) of the current frame, in other words, an increase in similarity between the power spectrum of the second voice signal of the current frame and the background noise model. Therefore, the decrease rate of the upper limit frequency fmax(t) becomes gradual.

When the upper limit frequency fmax(t) of the pseudo noise becomes less than or equal to a predetermined threshold value fth, the pseudo noise generation unit 14 stops generating the pseudo noise. In addition, the threshold value fth may be set to the upper limit frequency (for example, 4 kHz) of the second frequency band, for example.

In addition, in a case where the current frame is the voiceless time interval, the pseudo noise generation unit 14 does not update the upper limit frequency fmax(t), in other words, fmax(t)=fmax(t−1).

In accordance with the following Expression (8), the pseudo noise generation unit 14 generates the frequency spectrum of the pseudo noise from the background noise model over the frequency band containing the background noise model, in other words, over the entire first frequency band.

$$PNRE(i,t)=PN(i,t_0)\cdot\cos(\mathrm{RAND})$$

$$PNIM(i,t)=PN(i,t_0)\cdot\sin(\mathrm{RAND}) \quad (8)$$

Here, RAND is a random number having a value ranging from 0 to 2π and is generated for each frame in accordance with a random number generator included in the processing unit 7 or alternatively, an algorithm used for generating a random number and performed in the processing unit 7, for example. PNRE(i,t) indicates the real part of a spectrum at a frequency corresponding to the i-th sampling point of the pseudo noise in the current frame t, and PNIM(i,t) indicates the imaginary part of the spectrum at the frequency corresponding to the i-th sampling point of the pseudo noise in the current frame t. As illustrated in Expression (8), the pseudo noise is generated so that the amplitude of the pseudo noise at each frequency becomes equal to the amplitude of the background noise model at a corresponding frequency. From this, the pseudo noise having a frequency characteristic similar to the frequency characteristic of the background noise in a case of receiving the first voice signal. Therefore, it is hard for the user to perceive that the received voice is switched from the first voice signal to the second voice signal.

In addition, the pseudo noise is generated so that the phase of the pseudo noise at each frequency becomes uncorrelated with the phase of the background noise model at a corresponding frequency. Therefore, the pseudo noise becomes a more natural noise.

In a case where the current frame is not the voiceless time interval, the lower limit frequency of the pseudo noise generated in accordance with Expression (8) may be set to a frequency corresponding to a sampling point (Lmax+1) next to the sampling point Lmax corresponding to the upper limit frequency of the second voice signal.

By correcting, in accordance with the following Expression (9), the spectrum of the pseudo noise at each frequency using a coefficient η(i) defined based on the upper limit frequency fmax(t), the pseudo noise generation unit 14 removes a spectrum whose frequency is higher than the upper limit frequency fmax(t) from the pseudo noise generated in accordance with Expression (8).

$$\mathrm{OUT}PNRE(i,t)=\eta(i)\cdot\mathrm{OUT}PNRE(i,t)$$

$$\mathrm{OUT}PNIM(i,t)=\eta(i)\cdot\mathrm{OUT}PNIM(i,t)$$

$$\eta(i)=0 f\max(t)\leq f$$

$$\eta(i)=1-(f-(f\max(t)-\Delta f))/\Delta f f\max(t)-\Delta f\leq f<f\max(t)$$

$$\eta(i)=1 f<f\max(t)-\Delta f$$

$$f=i\cdot\Delta b \quad (9)$$

Here, Δf is the width of a frequency band, in which the pseudo noise is attenuated, and is 300 Hz, for example. In addition, Δb is the width of a frequency band corresponding to one sampling point. In addition, "f" is a frequency corresponding to the i-th sampling point.

Figure 7:
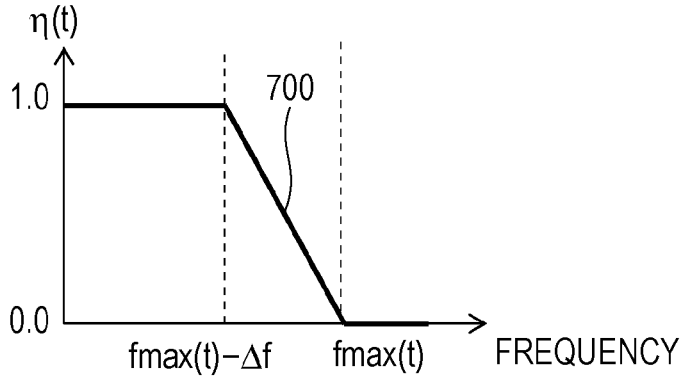
FIG. 7 is a diagram illustrating a relationship between a frequency and a coefficient $\eta(t)$.

FIG. 7 is a diagram illustrating a relationship between a frequency and the coefficient η(t). In FIG. 7, a horizontal axis indicates a frequency and a vertical axis indicates the coefficient η(t). In addition, a graph 700 indicates a relationship between a frequency and the coefficient η(t).

As is clear from Expression (9) and FIG. 7, as a frequency becomes higher than a frequency (fmax(t)−Δf), the spectrum of the pseudo noise at the relevant frequency becomes smaller. In addition, at a frequency higher than the upper limit frequency fmax(t), the spectrum of the pseudo noise becomes zero.

By applying frequency-time transform to the spectrum of the pseudo noise at each frequency, obtained for each frame, the pseudo noise generation unit 14 transforms the spectrum of the pseudo noise into the pseudo noise serving as a signal in a time domain. In addition, the pseudo noise generation unit 14 may use inverse FFT or inverse MDCT, as the frequency-time transform. In addition, the pseudo noise generation unit 14 outputs the pseudo noise to the superimposing unit 15 for each frame.

The superimposing unit 15 superimposes the pseudo noise on the second voice signal for each frame for which the pseudo noise is generated. In addition, the superimposing unit 15 sequentially outputs, to the output unit 8, the corresponding frame on which the pseudo noise is superimposed. Note that since the pseudo noise is not generated when the upper limit frequency fmax(t) of the pseudo noise becomes less than or equal to the predetermined frequency fth, the superimposing unit 15 stops superimposing the pseudo noise on the second voice signal. By stopping, in this way, superimposing the pseudo noise on the second voice signal in a case where the upper limit frequency fmax(t) of the pseudo noise is decreased to become less than or equal to the fth, the voice switching device 1 may make it hard for the user to perceive switching from the first voice signal to the second voice signal. In addition, by stopping, in this way, superimposing the pseudo noise at a time point when a certain amount of time period has elapsed, the voice switching device 1 may reduce a processing load due to generating and superimposing of the pseudo noise.

Figure 8:
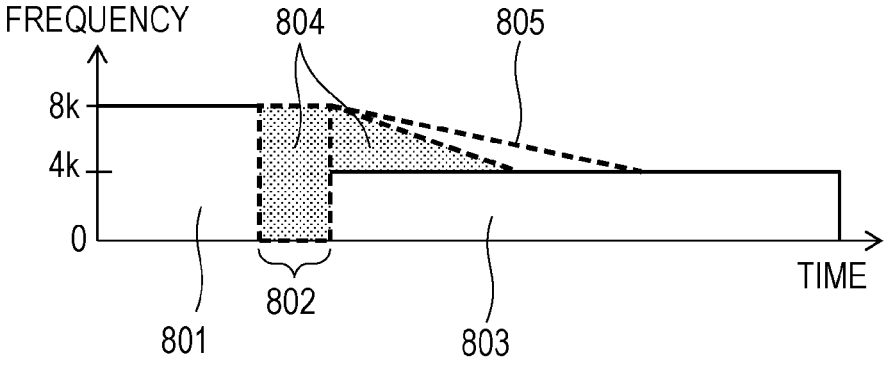
FIG. 8 is a pattern diagram illustrating voice signals output before and after a communication method of a voice signal is switched.

FIG. 8 is a pattern diagram illustrating voice signals output before and after a communication method of a voice signal is switched. In FIG. 8, a horizontal axis indicates time and a vertical axis indicates a frequency. Pseudo noise 804 is superimposed on a voiceless time interval 802 after reception of a first voice signal 801 is terminated and a given period of time after reception of a second voice signal 803 is started. In the voiceless time interval 802, a frequency band containing the pseudo noise 804 is identical to a frequency band containing the first voice signal 801. The upper limit frequency fmax(t) of the pseudo noise 804 is gradually decreased after the reception of the second voice signal 803 is started and superimposing of the pseudo noise is terminated at a time point when the upper limit frequency fmax(t) and the upper limit frequency of the second voice signal 803 coincide with each other. As the degree of similarity between the background noise model and the second voice signal becomes higher, a time period during which the pseudo noise 804 is superimposed on the second voice signal 803 becomes longer, as illustrated by a dotted line 805, for example.

Figure 9:
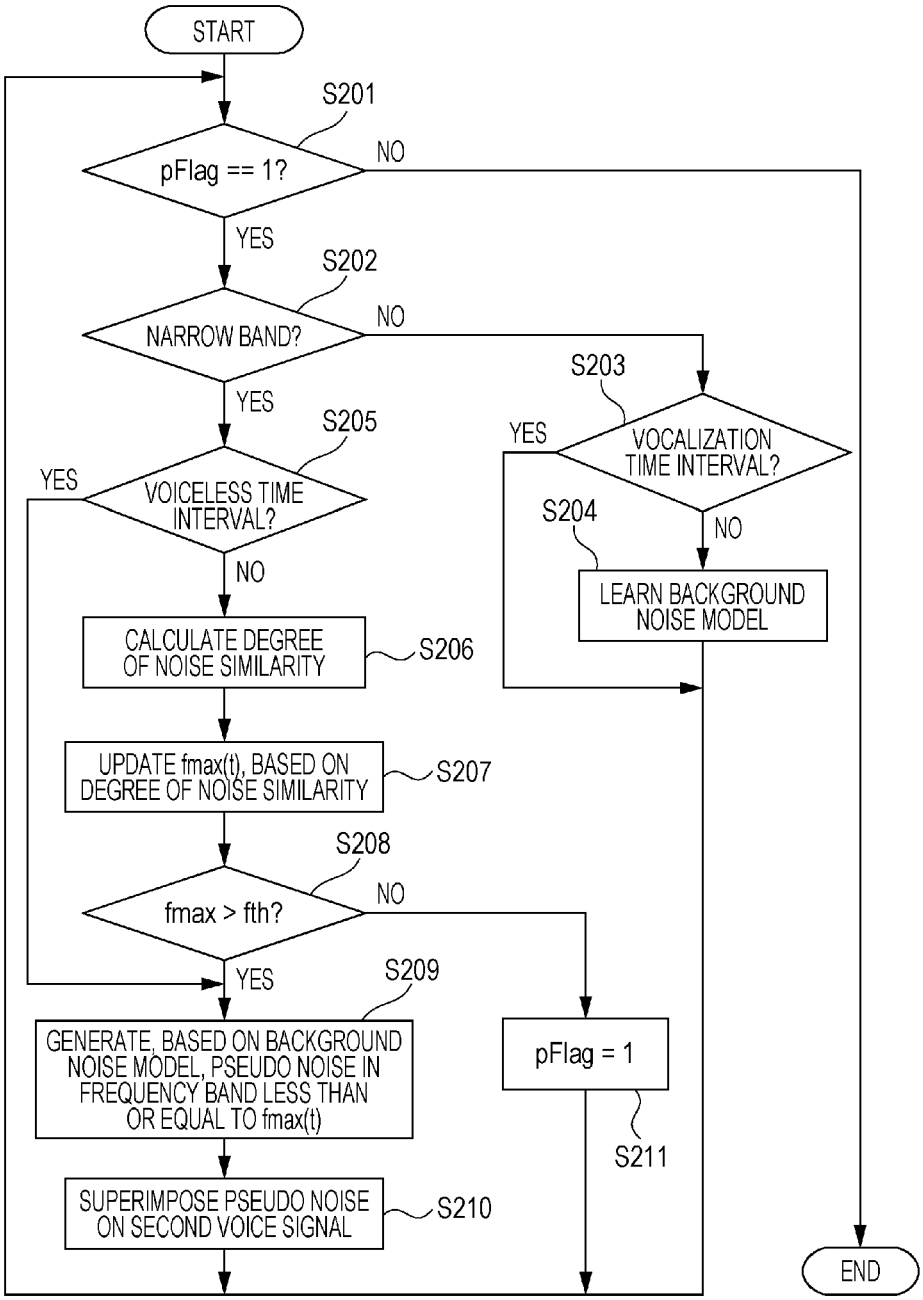
FIG. 9 is an operation flowchart of voice switching processing.

FIG. 9 is an operation flowchart of the voice switching processing performed by the processing unit 7. In accordance with this operation flowchart, the processing unit 7 performs the voice switching processing in units of frames.

The processing unit 7 determines whether or not a flag pFlag indicating whether or not the voice switching processing is running is a value, '1', indicating that the voice switching processing is running (step S201). When the value of the flag pFlag is '0' indicating that the voice switching processing finishes (step S201: No), the processing unit 7 terminates the voice switching processing. In addition, in a case where a communication method applied for transmitting a voice signal is switched from the second communication method to the first communication method or a call is started using the first communication method, the processing unit 7 rewrites the value of the pFlag to '1'.

On the other hand, in a case where the value of the flag pFlag is '1' (step S201: Yes), the processing unit 7 determines whether or not the voice signal of a current frame is the second voice signal having a relatively narrow transmission band (step S202). The processing unit 7 is able to determine whether or not a currently received voice signal is the second voice signal by referencing a communication method applied at the present moment.

In a case where the voice signal of the current frame is the first voice signal having a relatively wide transmission band (step S202: No), the learning unit 11 in the processing unit 7 determines whether or not the current frame is the vocalization time interval (step S203). In a case where the current frame is not the vocalization time interval (step S203: No), the learning unit 11 learns the background noise model, based on the power spectrum of the current frame at each frequency (step S204). After the step S204 or in a case where, in the step S203, it is determined that the current frame is the vocalization time interval (step S203: Yes), the processing unit 7 performs processing operations in and after the step S201 for a subsequent frame.

On the other hand, in a case where it is determined that the voice signal of the current frame is the second voice signal (step S202: Yes), the voiceless time interval detection unit 12 in the processing unit 7 determines whether or not the current frame is the voiceless time interval (step S205). In a case where the current frame is no the voiceless time interval (step S205: No), the degree-of-similarity calculation unit 13 in the processing unit 7 calculates the degree of noise similarity between the background noise model and the second voice signal of the current frame (step S206). And then, the pseudo noise generation unit 14 in the processing unit 7 updates the upper limit frequency fmax(t) of the pseudo noise, based on the degree of noise similarity (step S207). The pseudo noise generation unit 14 determines whether or not the fmax(t) is higher than the threshold value fth (step S208).

In a case where the fmax(t) is less than or equal to the fth (step S208: No), the pseudo noise does not have to be superimposed on the second voice signal. Therefore, the pseudo noise generation unit 14 rewrites the value of the pFlag to '0' (step S211).

On the other hand, in a case where the fmax(t) is higher than the fth (step S208: Yes), the pseudo noise generation unit 14 generates the pseudo noise in a frequency band less than or equal to the fmax(t) based on the background noise model (step S209). In a case where it is determined that the current frame is the voiceless time interval (step S205: Yes), the pseudo noise generation unit 14 generates the pseudo noise. In addition, the superimposing unit 15 in the processing unit 7 superimposes the pseudo noise on the second voice signal of the current frame (step S210). And then, the processing unit 7 outputs, to the output unit 8, the second voice signal on which the pseudo noise is superimposed.

After the step S210 or the step S211, the processing unit 7 performs the processing operations in and after the step S201 for the subsequent frame.

As described above, this voice switching device learns the background noise model, based on the first voice signal obtained while a call is made using the first communication method in which a frequency band containing a voice signal is relatively wide. At the time of switching, during a call, from the first communication method to the second communication method in which a frequency band containing a voice signal is relatively narrow, this voice switching device generates the pseudo noise, based on the learned background noise model. In addition, this voice switching device superimposes that pseudo noise on the voiceless time interval immediately after the switching and the second voice signal obtained using the second communication method. Furthermore, in accordance with the degree of similarity between the second voice signal after the switching and the background noise, this voice switching device adjusts a time period during which the pseudo noise is superimposed. From this, this voice switching device is able to reduce a feeling of uncomfortable of the user, due to a change in sound quality associated with switching of a communication method.

In addition, according to an example of a modification, based on a voice signal extracted from a received down-link signal, the processing unit 7 may determine whether or not switching from the first voice signal to the second voice signal is performed.

Figure 10:
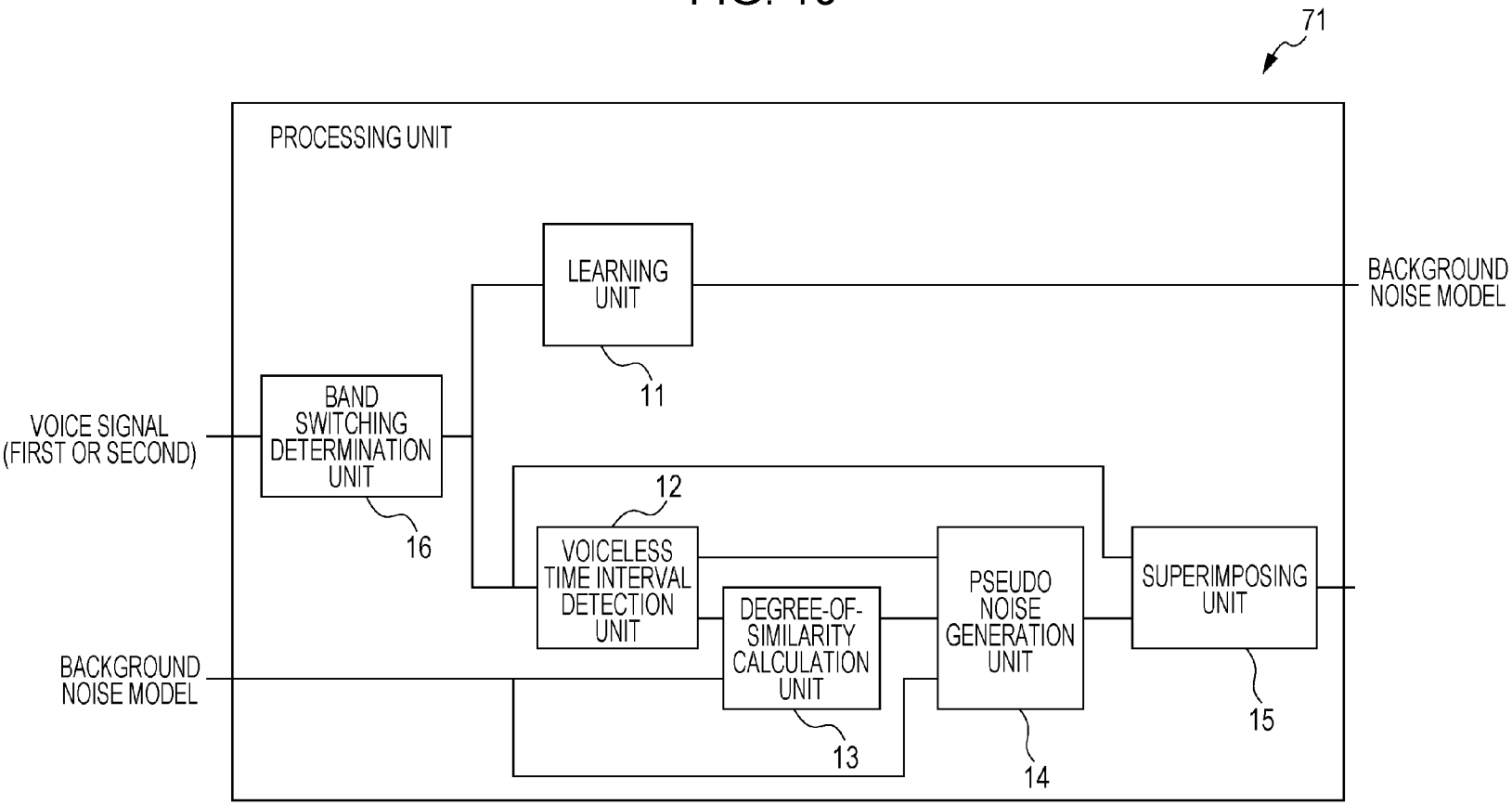
FIG. 10 is a schematic configuration diagram of a processing unit according to an example of a modification.

FIG. 10 is a schematic configuration diagram of a processing unit 71 according to this example of a modification. The processing unit 71 includes the learning unit 11, the voiceless time interval detection unit 12, the degree-of-similarity calculation unit 13, the pseudo noise generation unit 14, the superimposing unit 15, and a band switching determination unit 16.

These individual units included in the processing unit 71 are implemented as, for example, functional modules realized by a computer program performed on a processor included in the processing unit 71. Alternatively, the individual units included in the processing unit 71 may be implemented, as one integrated circuit for realizing the functions of the respective units, in the voice switching device 1 separately from the processor included in the processing unit 71.

Compared with the processing unit 7 according to the above-mentioned embodiment, the processing unit 71 according to this example of a modification is different in that the band switching determination unit 16 is included. Therefore, in what follows, the band switching determination unit 16 and a portion related thereto will be described.

For each frame, the band switching determination unit 16 subjects a received voice signal to time-frequency transform, thereby calculating the power spectrum thereof at each frequency. In addition, from the power spectrum, in accordance with the following Expression, the band switching determination unit 16 calculates power L(t) of the second frequency band and power H(t) of a frequency band obtained by subtracting the second frequency band from the first frequency band.

$$L(t) = 10\log_{10}\left(\frac{1}{L_{max}}\sum_{i=1}^{L_{max}} P(i, t)\right) \tag{10}$$

$$H(t) = 10\log_{10}\left(\frac{1}{H_{max} - L_{max}}\sum_{i=L_{max}+1}^{H_{max}} P(i, t)\right)$$

Here, Lmax is the number of a sampling point corresponding to the upper limit frequency of the second frequency band. In addition, Hmax is the number of a sampling point corresponding to the upper limit frequency of the first frequency band.

The band switching determination unit 16 compares a power difference Pdiff(t), obtained by subtracting the power H(t) from the power L(t), with a predetermined power threshold value ThB. In addition, in a case where the power difference Pdiff(t) is larger than the power threshold value ThB, the band switching determination unit 16 determines that a received voice signal is the second voice signal. Note that the power threshold value ThB is set to, for example, 10 dB. On the other hand, in a case where the power difference Pdiff(t) is less than or equal to the power threshold value ThB, the band switching determination unit 16 determines that the received voice signal is the first voice signal. In addition, in a case where it is determined, in a frame one frame prior to the current frame, that the first voice signal is received and it is determined, in the current frame, that the second voice signal is received, the band switching determination unit 16 determines that the received voice signal is switched from the first voice signal to the second voice signal. In addition, the band switching determination unit 16 informs the individual units in the processing unit 71 to that effect.

Upon being informed that the received voice signal is switched from the first voice signal to the second voice signal, the learning unit 11 stops updating the background noise model. In addition, upon being informed that the received voice signal is switched from the first voice signal to the second voice signal, the degree-of-similarity calculation unit 13 calculates, for each of subsequent frames, the degree of noise similarity during execution of the voice switching processing. In addition, upon being informed that the received voice signal is switched from the first voice signal to the second voice signal, the pseudo noise generation unit 14 generates the pseudo noise for each of subsequent frames.

According to this example of a modification, even when it is difficult to detect that a communication method used for transmitting a voice signal is switched, it is possible for the voice switching device to detect, based on a received voice signal, that the voice signal is switched from the first voice signal to the second voice signal. Therefore, it is possible for this voice switching device to adequately decide the timing of starting superimposing the pseudo noise on the second voice signal. Furthermore, since it is possible for this voice switching device to identify, based on the received voice signal itself, the timing of switching a voice signal, it is possible to apply this voice switching device to a device that only receives a voice signal from a communication device and regenerates the voice signal using a speaker.

Furthermore, according to another example of a modification, a time period during which the pseudo noise is superimposed on the second voice signal may be preliminarily set. The time period during which the pseudo noise is superimposed on the second voice signal may be set to, for example, 1 to 5 seconds from a time point when reception of the first voice signal based on the first communication method is terminated. In this case, the pseudo noise generation unit 14 may make the pseudo noise weaker as an elapsed time from a time point when reception of the first voice signal based on the first communication method is terminated becomes longer.

According to this example of a modification, the degree-of-similarity calculation unit 13 may be omitted. Therefore, the processing unit may simplify the voice switching processing.

Furthermore, a computer program that causes a computer to realize the individual functions of the processing unit in the voice switching device according to each of the above-mentioned individual embodiments or each of the above-mentioned examples of a modification may be provided in a form of being recorded in a computer-readable recording medium such as a magnetic recording medium or an optical recording medium.

All examples and all specific terms cited here are intended for an instructive purpose of helping a reader understand the present technology and a concept contributed by the present inventor for the promotion of the relevant technology and may be interpreted so as not to be limited to the configuration of any example of the present specification, such a specific cited example, or a specific cited condition, which is related to indicating the superiority or inferiority of the present technology. While embodiments of the present technology are described in detail, it may be understood that various modifications, permutations, and alterations may be added thereto without departing from the spirit and scope of the present technology.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A voice switching device comprising:

a processing unit including a processor, the processing unit being configured to:

learn a background noise model expressing background noise contained in a first voice signal, based on the first voice signal, while the first voice signal having a first frequency band is received;

generate pseudo noise expressing noise in a pseudo manner, based on the background noise model, after a first time point when the first voice signal is last received in a case where a received voice signal is switched from the first voice signal to a second voice signal having a second frequency band narrower than the first frequency band; and add the pseudo noise to the second voice signal after the first time point, wherein the processing unit further comprises:

a voiceless time interval detection unit configured to detect a voiceless time interval in which reception of the second voice signal is not started after the first time point, wherein the processing unit is further configured to:

generate the pseudo noise over the entire first frequency band in the voiceless time interval, and add the pseudo noise generated over the entire first frequency band in the voiceless time interval, divide the second voice signal into frame units each having a predetermined length of time, calculate a power spectrum at each frequency by subjecting the second voice signal to time- frequency transform for each of the frames, calculate the degree of flatness indicating how flat the power spectrum is over the second frequency band for each of the frames, calculate the degree of similarity by obtaining an error of a power spectrum between the second voice signal and the background noise model at each frequency over the entire second frequency band in a case where the degree of flatness is greater than or equal to a predetermined threshold value, and calculate the degree of similarity by obtaining an error of a power spectrum between the second voice signal and the background noise model at each frequency contained in a sub frequency band, the sub frequency band being narrower than the second frequency band and containing a frequency at which the power spectrum becomes a local minimum value, in a case where the degree of flatness is less than the predetermined threshold value.

2. The voice switching device according to claim 1, wherein in a time interval not included in the voiceless time interval after the first time point, the processing unit generates the pseudo noise in a frequency band between an upper limit frequency of the pseudo noise and an upper limit frequency of the second frequency band, the upper limit frequency of the pseudo noise being higher than the upper limit frequency of the second frequency band and less than or equal to an upper limit frequency of the first frequency band.

3. The voice switching device according to claim 2, wherein the processing unit decreases the upper limit frequency of the pseudo noise as an elapsed time other than the voiceless time interval after the first time point becomes longer.

4. The voice switching device according to claim 3, wherein the processing unit stops adding the pseudo noise to the second voice signal in a case where the upper limit frequency of the pseudo noise becomes less than or equal to the upper limit frequency of the second frequency band.

5. The voice switching device according to claim 3, wherein the processing unit is also configured to:

calculate the degree of similarity indicating how similar the background noise model and the second voice signal are to each other in a time interval other than the voiceless time interval after the first time point, wherein cause the upper limit frequency of the pseudo noise to decrease more gradually as the degree of similarity becomes higher.

6. The voice switching device according to claim 1, wherein the background noise model includes an amplitude at each frequency, and wherein the processing unit is further configured to determine an amplitude of the pseudo noise at each frequency in accordance with an amplitude of the background noise model at a corresponding frequency.

7. The voice switching device according to claim 1, wherein the processing unit is further configured to generate the pseudo noise over a predetermined time period after the first time point and makes the pseudo noise weaker as an elapsed time from the first time point becomes longer.

8. The voice switching device according to claim 1, wherein the first voice signal is indicative of the background noise when power of the first voice signal in a certain frame is smaller than a certain threshold.

9. A voice switching method comprising:

learning a background noise model expressing background noise contained in a first voice signal, based on the first voice signal, while receiving the first voice signal having a first frequency band;

generating pseudo noise expressing noise in a pseudo manner, based on the background noise model, after a first time point when the first voice signal is last received in a case where a received voice signal is switched from the first voice signal to a second voice signal having a second frequency band narrower than the first frequency band;

detecting a voiceless time interval in which reception of the second voice signal is not started after the first time point;

adding the pseudo noise to the second voice signal after the first time point;

generating the pseudo noise over the entire first frequency band in the voiceless time interval;

adding the pseudo noise generated over the entire first frequency band in the voiceless time interval; and dividing the second voice signal into frame units each having a predetermined length of time, calculate a power spectrum at each frequency by subjecting the second voice signal to time-frequency transform for each of the frames, calculate the degree of flatness indicating how flat the power spectrum is over the second frequency band for each of the frames, calculate the degree of similarity by obtaining an error of a power spectrum between the second voice signal and the background noise model at each frequency over the entire second frequency band in a case where the degree of flatness is greater than or equal to a predetermined threshold value, and calculate the degree of similarity by obtaining an error of a power spectrum between the second voice signal and the background noise model at each frequency contained in a sub frequency band, the sub frequency band being narrower than the second frequency band and containing a frequency at which the power spectrum becomes a local minimum value, in a case where the degree of flatness is less than the predetermined threshold value.

10. A non-transitory computer-readable recording medium having stored therein a program for causing a computer to execute a process for switching a voice, the process comprising:

learning a background noise model expressing background noise contained in a first voice signal, based on the first voice signal, while receiving the first voice signal having a first frequency band;

generating pseudo noise expressing noise in a pseudo manner, based on the background noise model, after a first time point when the first voice signal is last received in a case where a received voice signal is switched from the first voice signal to a second voice signal having a second frequency band narrower than the first frequency band;

detecting a voiceless time interval in which reception of the second voice signal is not started after the first time point;

adding the pseudo noise to the second voice signal after the first time poin;

generating the pseudo noise over the entire first frequency band in the voiceless time interval, adding the pseudo noise generated over the entire first frequency band in the voiceless time interval; and dividing the second voice signal into frame units each having a predetermined length of time, calculate a power spectrum at each frequency by subjecting the second voice signal to time-frequency transform for each of the frames, calculate the degree of flatness indicating how flat the power spectrum is over the second frequency band for each of the frames, calculate the degree of similarity by obtaining an error of a power spectrum between the second voice signal and the background noise model at each frequency over the entire second frequency band in a case where the degree of flatness is greater than or equal to a predetermined threshold value, and calculate the degree of similarity by obtaining an error of a power spectrum between the second voice signal and the background noise model at each frequency contained in a sub frequency band, the sub frequency band being narrower than the second frequency band and containing a frequency at which the power spectrum becomes a local minimum value, in a case where the degree of flatness is less than the predetermined threshold value.

* * * * *